US007691258B2

(12) United States Patent
Venkateshan

(10) Patent No.: US 7,691,258 B2
(45) Date of Patent: Apr. 6, 2010

(54) PROCESS FOR TREATING HYDROCARBON LIQUID COMPOSITIONS

(75) Inventor: Maharajapuram Subramanian Venkateshan, Dubai (AE)

(73) Assignee: Emirates National Oil Company Limited (ENOC) LLC, Dubai (AE)

( * ) Notice: Subject to any disclaimer, the term of this patent is extended or adjusted under 35 U.S.C. 154(b) by 266 days.

(21) Appl. No.: 11/757,542

(22) Filed: Jun. 4, 2007

(65) Prior Publication Data

US 2008/0296204 A1 Dec. 4, 2008

(51) Int. Cl.
*C10G 25/00* (2006.01)

(52) U.S. Cl. ..... 208/299; 208/15; 208/187; 208/188; 208/255; 208/263; 208/303

(58) Field of Classification Search ..... 208/189–207, 208/15, 255, 263, 299, 303; 502/400, 414, 502/80

See application file for complete search history.

(56) References Cited

U.S. PATENT DOCUMENTS

| | | | | |
|---|---|---|---|---|
| 2,090,007 | A | 8/1937 | MacKenzie | |
| 2,204,234 | A | 6/1940 | Schulze | |
| 2,312,020 | A | 2/1943 | Bottomley | |
| 2,759,873 | A * | 8/1956 | McNeill et al. | 208/192 |
| 3,529,944 | A * | 9/1970 | Leas | 44/398 |
| 4,120,782 | A | 10/1978 | Audeh et al. | |
| 6,422,396 | B1 | 7/2002 | Li et al. | |
| 6,485,633 | B2 | 11/2002 | Wismann et al. | |
| 6,569,330 | B1 * | 5/2003 | Sprenger et al. | 210/315 |
| 6,579,444 | B2 | 6/2003 | Feimer et al. | |
| 7,223,332 | B1 * | 5/2007 | Tertel | 208/208 R |
| 2006/0167326 | A1 | 7/2006 | Burdett et al. | |

FOREIGN PATENT DOCUMENTS

| | | | |
|---|---|---|---|
| AU | 40338/78 | A1 | 3/1978 |
| EP | 0278792 | A2 | 2/1988 |
| EP | 0712922 | A2 | 11/1995 |
| WO | 2005037969 | A2 | 4/2005 |

OTHER PUBLICATIONS

Parkash, S. (2003). Refining Processes Handbook, Elsevier, 688 pgs. (Office action references chapter 7, pp. 210-219).*
Velcon CO-718CE Datasheet (2005, Document 1231-R13 04/02).*
International Search Report, PCT/IB2008/001433, Oct. 27, 2008.
Jet Fuel Conductivity; Joint Inspection Group; Jun. 2009; pp. 1-4; Bulletin No. 25; www.jointinspectiongroup.org.
Facet International Datasheets (http://facetinternational.net/avclaygen.htm).

* cited by examiner

*Primary Examiner*—Glenn A Caldarola
*Assistant Examiner*—Brian McCaig
(74) *Attorney, Agent, or Firm*—Dinsmore & Shohl LLP

(57) ABSTRACT

A process for treating a hydrocarbon liquid composition to improve its storage and/or transportation stability, comprises contacting the hydrocarbon liquid composition with a polar trap, wherein the conductivity of the hydrocarbon liquid composition is not reduced by said contacting with a polar trap. The polar trap may be a clay treater containing attapulgus clay. The process may include sequentially passing the hydrocarbon liquid composition through a dehydrator and a clay treater at a flow rate of between about 100 and about 1000 $m^3$ per hour. Advantageously, the hydrocarbon liquid composition is refined and in particular, may be a Merox™-treated jet fuel.

28 Claims, 2 Drawing Sheets

PROCESS FOR TREATING HYDROCARBON LIQUID COMPOSITIONS

FIELD OF THE INVENTION

This invention relates to a process for treating a hydrocarbon liquid composition to improve its storage and/or transportation stability; and in particular, to a process for improving the storage and/or transportation stability of jet fuel produced by "Merox™" treatment.

BACKGROUND OF THE INVENTION

Crude petroleum (also called "crude oil" or "crude") is composed primarily of hydrocarbons of paraffin, naphthene, and aromatic types: each of these groups contains a broad range of molecules and hence, the composition and properties of the crude can vary significantly. Most jet fuels are made by refining crude petroleum under carefully controlled process conditions.

Processes for the production of jet fuel are known to the person skilled in the art and many technical descriptions are available (see for example, "*Aviation Fuels—Technical Review*", FTR-3 (2005), published by Chevron Texaco).

In brief, the refining process can generally be considered to comprise four stages of treatment. First, separation processes (most commonly, distillation), in which the crude is separated into two or more components based on a physical property, such as boiling point. Secondly, upgrading processes (for example, "sweetening", hydrotreating and clay treating), which improve the quality of the material by using chemical reactions to remove undesirable (trace) compounds. A standard sweetening process used in the production of jet fuels is Merox™ treatment. Physical processes such as filtering/coalescing to remove particulate matter and/or water contamination can be considered to be a third category of treatment. The fourth stage relates to conversion processes (such as catalytic cracking and hydrocracking), in which the molecular structure of the feedstock is changed, for example, by "cracking" (breaking down) large molecules into smaller more desirable molecules. In addition, depending on the intended use of the hydrocarbon product, one or more chemical additives may be added so that the fuel meets any relevant quality specifications.

Fuel additives are now considered almost essential for meeting the strict quality and performance parameters (for example, oxidation stability requirements) set for jet fuels. In fact, fuel additives may be used for a number of important applications, for example: antibacterial agents are useful for preventing the growth of microorganisms that may otherwise break down the fuel and/or block fuel lines; anti-icing chemicals may be used to prevent the freezing of any water contamination when the fuel is exposed to low temperatures (e.g. at high altitudes); antioxidants may be used to prevent dissolved oxygen from setting off chains of oxidation reactions and, thus, to improve storage stability; metal deactivator agents may be used to chelate metals, such as copper and zinc, that may catalyse oxidation reactions; corrosion inhibitors are useful for preventing the corrosion of storage tanks and distribution pipelines by oxygen and water in the fuel; and electrical conductivity agents (e.g. anti-static and/or static-dissipater additives) are often included to maintain a minimum electrical conductivity, which helps prevent static charge build up. Suitable additives for use in jet fuel are known to the skilled person in the art, and are discussed, for example, in Aviation Fuels: Technical Review (FTR 3), 2005, Chapter 4, Edited by Chevron Texaco.

Jet fuel, such as Aviation Turbine Fuel (Jet A1), is subject to particularly strict quality specification parameters and, therefore, jet fuel must be "certified" before it can be accepted for its intended use. The required fuel specifications may vary according to national or institutional requirements and the intended use. Hence, the various parameters defining the quality of jet fuel are published and updated periodically, most notably by The Director, Defence Fuels Group, UK, under the title Defence Standard 91-91 (DEFSTAN 91-91), and these parameters are well known to those who deal with the fuel. Updated information on jet fuel specification parameters in force in different parts of the world may also be periodically published by commercial organisations such as, for example, ExxonMobil Aviation International Ltd.

A refined hydrocarbon liquid composition (such as a jet fuel) is typically tested at the refinery to ensure that it meets the appropriate specification parameters before it is distributed. However, the distribution chain from the refinery to the point at which the product is used may be both convoluted and slow. For example, a jet fuel may be pumped or transported to one or more fuel terminals (e.g. by ocean tanker or pipeline) for intermediate storage, before it is delivered to an airport terminal, where it also may be stored until it is finally delivered into an aircraft. Such distribution chains can mean that an already certified fuel is exposed to various sources of possible contamination (for example, when transported through pipes or in tanks that have been used for different fuels), and exposed to variable temperatures over prolonged periods of time, which may cause fuel degradation.

It is known that fuel properties can deteriorate significantly during the distribution (and storage) chain, and this deterioration can lead to significant operational difficulties downstream of the refinery, even though the fuel may still fall within the specification parameters. For example, surfactants, ionic species (such as metal ions), particulate matter and water can all build up in fuel during its storage and transportation. Surfactants can occur naturally in crude oils (e.g. naphthenic acids), they may be introduced during the refining process, or may be picked up from contaminated pipes and containers. Ionic species, such as metal ions/oxides and particulate matter are typically introduced through the deterioration (e.g. corrosion) of metal fuel transportation pipelines and storage tanks. Particulate matter can originate from the corrosion of pipelines, storage tanks, and through chemical reactions taking place in the fuel, or by the action of microorganisms. Water can be absorbed through contact with air and by the transportation of fuel; for example, containers and pipes may be washed with water between different shipments. All of these contaminants lead to premature "disarming" (i.e. inactivation) of water filters, which are used, for example, at airports to remove water from jet fuel immediately before it is loaded into an aircraft. It is, therefore, very important to minimise the build up of such contaminants, or to remove the contaminants prior to the final water filtration step, to: (i) prevent the transmission of unacceptably high levels of water through the filter; and (ii) extend the service life of the filter.

At least a part of the cause for the degradation of fuel during storage and transportation and the resulting build up of contaminants is recognised to be the presence of sulfur, oxygen and nitrogen based compounds in petroleum fractions. These compounds, in particular sulphur-based compounds are also undesirable from an environmental standpoint. Hence, refineries and associated downstream facilities have developed a number of processes that are intended to remove or minimise detrimental materials, so that the quality of the fuel end-product is maintained within the original specification limits.

For example, U.S. Pat. No. 2,090,007 (August 1937), describes a process for treating cracked gasoline to meet marketing requirements by using chemicals such as an acid or an alkali and then passing the fuel through a column containing Fuller's Earth or charcoal as a medium to remove the impurities and improve the quality of the resulting product. This patent outlines the utilisation and abilities of attapulgus clay to remove unwanted impurities in the gasoline fraction of fossil fuel. Such clay treaters are employed routinely in the initial refining of crude petroleum.

U.S. Pat. No. 3,529,944 (September 1970) relates to a process for refining fuel fractions, such as jet fuels, in particular to improve thermal stability. The process described involves the addition, at the petroleum refinery, of degradation accelerators in order to catalyse the formation of particulate impurities, followed by treatment (for example, at a fuel depot) with a solid, particulate adsorbent media such as natural or synthetic clays, fuller's earth, attapulgite and silica gel to removed the contaminants. Finally, it is necessary to reintroduce stabilising chemicals, such as antioxidants, into the treated fuel to retard any further degradation of the fuel before use.

Another identified cause for the degradation of fuel during storage and transportation is contamination of the refined fuel with catalysts and by-products of the Merox™ process, which is routinely used for demercaptanisation of crude petroleum.

U.S. Pat. No. 6,579,444 (June 2003) relates to a process for removal of sulfur compounds from a hydrocarbon stream. The adsorbent material comprises of cobalt and one or more group VI metals selected from molybdenum and tungsten on an inorganic refractory support, which is chosen from alumina, silica or large pore zeolites. This patent identifies some of the problems associated with Merox™ treating of hydrocarbons, such as sodium and water contaminated product streams; and the non-removal of sulfur compounds such as sulfides and thiophenes, oxygen compounds such as phenols, phenolates and peroxides, and nitrogen compounds such as amines or nitrates.

An alternative to Merox™ treatment for demercaptanisation of petroleum distillates such as gasoline, kerosene and diesel fractions is described in U.S. Pat. No. 6,485,633 (November 2002). The demercaptanisation in this case is achieved by sorption of the mercaptans with activated carbon. This patent identifies the possible contamination of the refined distillate streams with the remnants of the catalysts used in demercaptanisation processes such as the Merox™ processes.

U.S. Pat. No. 6,422,396 identifies the problem of rapid disarming of conventional water separators due to inter alia surfactants in refined hydrocarbon streams. The patent describes a coalescer (water filter) for use in hydrocarbon streams that contain surfactant, and which is intended to separate a discontinuous phase of water from a continuous phase of hydrocarbons, such as jet fuel. In addition, the patent discusses the unsuitability of alternative methods for preventing the disarming of water separators, such as upstream use of a clay treater. Further in this regard, it is stated that the use of a clay treater is inappropriate, because a clay treater also removes desirable surfactants in the fuel.

The Coordinating Research Council (CRC) in its report no. 552 (February 1987) studied the removal of surfactants from jet fuel using activated clay elements. However, the study suggested methods of testing such as ASTM D 3602/ASTM D 3630, which have become obsolete and no longer in use. Furthermore, it is notable that the use of ASTM D 3948 suffers from a lack of reproducibility at WSIM ratings (i.e Water Separometer Index, Modified rating also known as MSEP—Micro Separometer—rating) of around 90, which has a detrimental effect on the precision of these tests. In addition, this study suggests that if the WSIM or MSEP rating drops to about 90 or below then the clay bed starts to deteriorate. Therefore, the method described may not be applicable for jet fuels that may have WSIM ratings as low as 70.

Accordingly, there is a need for a means of treating a hydrocarbon liquid composition to improve fuel quality by eliminating or at least alleviating the problem of contaminant build up during the storage and transportation of the hydrocarbon liquid composition, and which means does not result in undesirable side-effects or by-products. In particular, there is a need for a method or process for treating a hydrocarbon liquid composition in order to extend the service life of water filters, for example, at airports; and to prevent or at least reduce the transmission of unacceptably high levels of water through a water filter.

Another problem associated with the storage and transportation of certified fuels is that the conductivity level of the fuel can drop significantly over time, to below optimal levels. Moreover, the previously discussed problems caused by the reduced efficiency of water removal from fuel can be exacerbated due to this decrease in fuel conductivity during storage and transportation. In this regard, static dissipaters or anti-static additives (for example, ASA-3 and Stadis® 450), which are added to fuel to maintain acceptable conductivity levels, also act as weak surfactants, which can increase the difficulty of removing water from fuel.

This is known to be a particular problem with non-hydrotreated fuels (e.g. Merox™-sweetened fuels). In this case, it has been found that the interaction of the static dissipater compound with the non-hydrotreated fuel can result in a rapid deterioration in the conductivity of the fuel; however, despite this effect the MSEP or WSIM rating surprisingly does not rise proportionally. Hence, any further addition (redoping) of static dissipater to counteract the drop in conductivity causes a further drop in water separability (i.e. a lower MSEP rating), potentially to levels below the acceptable minimum value of 70 when static dissipaters are used. This problem is most significant when Stadis® 450 is used, because it causes a greater proportional reduction in MSEP rating than does ASA-3 (CRC Report No. 601; *The Effect of Stadis* 450 *on MSEP Rating and Coalescence—Technical Basis for Re-doping Turbine Fuels with Stadis* 450; July 1996; Coordinating Research Council Inc., Georgia, USA). Although this report suggests that Stadis® 450 may not directly disarm coalescers (despite the measured reduction in MSEP rating), the report highlights concerns over the levels of contamination that can build up during the transportation and storage of fuels.

Hence, it would also be desirable to have a method or process for treating a hydrocarbon liquid composition, such as a jet fuel, which prevents or at least alleviates the problems associated with loss of conductivity during storage and transportation. In this way, any redoping of static dissipater or anti-static compounds that may be required to achieve the desired conductivity level may be eliminated or at least reduced.

It would be further desirable to have a method or process for treating a hydrocarbon liquid composition, such as a jet fuel, which prevents or at least alleviates some of the problems associated with a reduction in water separability (as indicated by a reduced MSEP rating), that can result during storage and transportation, and particularly as a result of the redoping of static dissipater or anti-static compounds to maintain the desired conductivity level.

This invention aims to address at least some of the above problems in the prior art, by providing a process that improves the quality of hydrocarbon liquid compositions such as fractions of petroleum crudes, condensates and compositions including petroleum distillates, naphthas, gasolines, kerosenes, jet fuels, diesel fuels, fuel oils and the like, which can deteriorate from specification parameters during storage and transportation (shipment), and consequently lead to operational difficulties that affect the performance of supply chain management downstream of the refinery.

It is thus an object of this invention to ensure improvement in quality of petroleum products, and particularly Merox™-treated jet fuels. Another object of this invention is the use of clay treaters as novel polar-exchangers to remove from the hydrocarbon liquid compositions, sub-ppm levels of impurities whose presence can cause a deterioration of quality parameters on storage and transportation, but which does not adversely affect the conductivity of the hydrocarbon liquid composition. These and other aspects, objects and the benefits of this invention will become clear and apparent on studying the details of this invention and the appended claims.

SUMMARY OF THE INVENTION

Thus, in accordance with a first aspect of the invention there is provided a process for improving the storage and/or transportation stability of a hydrocarbon liquid composition, the process comprising: contacting the hydrocarbon liquid composition with a polar trap, wherein the conductivity of the hydrocarbon liquid composition is not reduced by said contacting with a polar trap. This provides the advantage that polar molecules that can cause the deterioration of the hydrocarbon liquid composition, for example, by reacting with trace contaminants in the fuel, or with the surfaces of storage containers or pipelines; and which cause the ineffectiveness and disarming of water filters are removed. However, the desirable property of conductivity is not adversely affected. Advantageously, the conductivity of the hydrocarbon liquid composition is actually increased by said contacting with a polar trap.

The hydrocarbon liquid composition may be selected from the group consisting of: petroleum crudes; condensates; and compositions including petroleum distillates, naphthas, gasolines, kerosenes, jet fuels, diesel fuels and fuel oils. Suitably, the hydrocarbon liquid composition is selected from jet fuel, post-certification jet fuel, and Merox™-treated post-certification jet fuel. A particularly suitable hydrocarbon liquid composition is a Merox™-treated post-certification jet fuel.

The polar trap used in accordance with the invention suitably comprises a material selected from the group consisting of clay, Fuller's earth, activated alumina, silica, and zeolites. More suitably, the polar trap is a clay treater, which suitably comprises attapulgus clay.

In addition, the processes of the invention may have the further beneficial effect of increasing the MSEP (or WSIM) rating of the hydrocarbon liquid composition. The MSEP rating may be measured using, for example, the Model 1140 Micro-Separometer Mark V Deluxe, available from M/s EMCEE Electronics, Inc., 520, Cypress Ave., Venice, Fla. 34292, USA.

Typically, the contacting step is carried out by passing the hydrocarbon liquid composition through the polar trap at a flow rate of between about 100 and about 1000 $m^3$ per hour, suitably between about 300 and about 1000 $m^3$ per hour, more suitably between about 400 and about 800 $m^3$ per hour, and still more suitably between about 500 and about 700 $m^3$ per hour. Under these conditions, the beneficial effects of the claimed process have been found to be particularly apparent.

Advantageously, the process of the invention is performed immediately prior to the storage or transportation of the hydrocarbon liquid composition, so as to reduce or eliminate the possibility of further deterioration in the quality of the composition.

Further beneficial effects have been found when before the step of contacting with a polar trap is performed the hydrocarbon liquid composition is first contacted with a dehydrator. In this way, particularly reproducible and advantageous effects on conductivity and water separability have been found. Alternatively, benefits are achieved when the process of the invention includes the sequential steps of contacting the hydrocarbon liquid composition with a dehydrator and then a micronic filter before said contacting with a polar trap is performed. The pre-treatment with a micronic filter before the step of contacting with a polar trap may optionally be employed without the prior use of a dehydrator; however, in one embodiment a dehydrator is also employed.

Thus, the invention provides a process for improving the storage and/or transportation stability of a hydrocarbon liquid composition, the process comprising: contacting the hydrocarbon liquid composition with a polar trap, wherein the conductivity and the MSEP rating (measured using the Water Separometer Index, Modified, WSIM rating) of the hydrocarbon liquid composition is increased by said contacting with a polar trap.

In another aspect the invention provides a process for improving the storage and/or transportation stability of a hydrocarbon liquid composition, the process comprising sequentially the steps of passing the hydrocarbon liquid composition through: (a) a dehydrator; and (b) a polar trap, suitably a clay treater, such as attapulgus clay; at a flow rate of between about 100 and about 1000 $m^3$ per hour; and wherein the conductivity of the hydrocarbon liquid composition immediately following step (b) is not less than the conductivity of the hydrocarbon liquid composition immediately preceding step (b). Advantageously, the conductivity of the hydrocarbon liquid composition immediately following step (b) is greater than the conductivity of the hydrocarbon liquid composition immediately preceding step (b). In a particularly beneficial embodiment the conductivity and the MSEP rating (measured using the Water Separation Characteristics by portable separometer, which is comparable to WSIM rating) of the hydrocarbon liquid composition immediately following step (b) is higher than the conductivity and the MSEP rating of the hydrocarbon liquid composition immediately preceding step (b).

In certain beneficial aspects and embodiments, the process may further comprise, between steps (a) and (b), the step of: (a') passing the hydrocarbon liquid composition through a micronic filter, suitably of approximately 5 μm pore size. In one embodiment, the process further comprises between steps (a) and (b), the step of: (a') passing the hydrocarbon liquid composition through a micronic filter, suitably of approximately 5 μm pore size; and after step (b), the step of: (c) passing the hydrocarbon liquid composition through a micronic filter, suitably of approximately 5 μm pore size.

As in all aspects and embodiments of the invention, the hydrocarbon liquid composition may be a jet fuel, suitably a post-certification jet fuel, and more suitably a Merox™-treated post-certification jet fuel. Advantageously, the process is carried out immediately prior to the storage or transportation of the hydrocarbon liquid composition.

Advantageously, the flow rate for the hydrocarbon liquid composition through the polar trap is between about 300 and about 1000 $m^3$ per hour, more suitably between about 400 and about 800 $m^3$ per hour, and beneficially between about 500 and about 700 $m^3$ per hour.

Hence, a further aspect of the invention provides a process for improving the storage and/or transportation stability of a hydrocarbon liquid composition, the process comprising sequentially the steps of passing the hydrocarbon liquid composition through: (a) a dehydrator; (a') a micronic filter, suitably of approximately 5 μm pore size; (b) a polar trap; and (c) a micronic filter, suitably of approximately 5 μm pore size; at a flow rate of between about 100 and about 1000 $m^3$ per hour; and wherein the conductivity of the hydrocarbon liquid composition immediately following step (b) is not less than the conductivity of the hydrocarbon liquid composition immediately preceding step (b).

As before, the hydrocarbon liquid composition may be selected from the group consisting of: petroleum crudes; condensates; and compositions including petroleum distillates, naphthas, gasolines, kerosenes, jet fuels, diesel fuels and fuel oils.

In particularly advantageous embodiments the polar trap is a clay treater, which typically comprises attapulgus clay In another aspect there is provided a process for treating a refined hydrocarbon liquid composition, comprising sequentially the steps of passing the refined hydrocarbon liquid composition through: (a) a dehydrator; and (b) a polar trap; at a flow rate of between about 100 and about 1000 $m^3$ per hour. The process is particularly beneficial for use with refined hydrocarbon liquid compositions, because: (i) the refining process, such as Merox™ treatment can cause the introduction of chemicals that promote deterioration of fuels, but which do not affect the certification of the fuel; and (ii) since the hydrocarbon liquid has already been refined, it is important to minimise or prevent any deterioration in its quality. Hence, the refined hydrocarbon liquid composition is suitably a jet fuel, beneficially a post-certification jet fuel, and particularly a Merox™-treated post-certification jet fuel.

In one embodiment of this aspect of the invention and in others, the process further comprises, between steps (a) and (b), the step of: (a') passing the hydrocarbon liquid composition through a micronic filter, suitably of approximately 5 μm pore size. In the alternative, the process may also further comprise between steps (a) and (b), the step of: (a') passing the hydrocarbon liquid composition through a micronic filter, suitably of approximately 5 μm pore size; and after step (b), the step of: (c) passing the hydrocarbon liquid composition through a micronic filter, suitably of approximately 5 μm pore size.

In all aspects of the invention, the flow rate of the refined hydrocarbon liquid composition is suitably between about 300 and about 1000 $m^3$ per hour, beneficially between about 400 and about 800 $m^3$ per hour, and advantageously between about 500 and about 700 $m^3$ per hour.

As in other aspects of the invention, the polar trap advantageously comprises a material selected from the group consisting of clay, Fuller's earth, activated alumina, silica, and zeolites. In some embodiments the polar trap is suitably a clay treater, wherein the clay treater advantageously comprises attapulgus clay.

In yet another aspect there is provided a process for treating a refined hydrocarbon liquid composition, comprising sequentially the steps of passing the refined hydrocarbon liquid composition through: (a) a dehydrator; (a') a micronic filter, suitably of approximately 5 μm pore size; (b) a clay treater, suitably comprising attapulgus clay; and (c) a micronic filter, suitably of approximately 5 μm pore size; at a flow rate of between about 100 and about 1000 $m^3$ per hour.

In beneficial embodiments, the conductivity of the refined hydrocarbon liquid composition immediately following step (b) is higher than the conductivity of the hydrocarbon liquid composition immediately preceding step (b). In further beneficial embodiments, the MSEP rating (measured using the Water Separation Characteristics by portable separometer which is comparable to WSIM rating) and the conductivity of the refined hydrocarbon liquid composition immediately following step (b) are higher than the conductivity and the MSEP rating of the hydrocarbon liquid composition immediately preceding step (b).

Another aspect of the invention provides a method for improving the storage and/or transportation stability of a hydrocarbon liquid composition by using a polar trap, wherein the polar trap acts as a polar-exchanger whereby polar molecules in the hydrocarbon liquid composition are adsorbed from the hydrocarbon liquid composition and less polar molecules present in the polar trap are desorbed into the hydrocarbon liquid composition and/or retained in the hydrocarbon liquid composition, such that the conductivity of the hydrocarbon liquid composition is not reduced by said use of a polar trap.

As in other aspects of the invention, suitably the polar trap is a clay treater, and the clay treater beneficially comprises attapulgus clay. Likewise, the hydrocarbon liquid composition is suitably a jet fuel, more suitably a post-certification jet fuel, and still more suitably a Merox™-treated post-certification jet fuel.

There is also provided a method for increasing the conductivity of a refined hydrocarbon liquid composition by passing the refined hydrocarbon liquid composition through a polar trap at a flow rate of between about 100 and about 1000 $m^3$ per hour. Beneficially, the flow rate is between about 300 and about 1000 $m^3$ per hour, advantageously between about 400 and about 800 $m^3$ per hour, and more advantageously between about 500 and about 700 $m^3$ per hour. In some embodiments this method further comprises, before passing the refined hydrocarbon liquid composition through a polar trap, passing the refined hydrocarbon liquid composition through a dehydrator. Particularly beneficially, the MSEP rating of the refined hydrocarbon liquid composition is also increased.

Advantageously, the polar trap is a clay treater, which typically comprises attapulgus clay.

In another aspect the invention provides the use of a clay treater as a polar-exchanger for improving the storage and/or transportation stability of a hydrocarbon liquid composition, wherein before the storage and/or transportation, the clay treater is contacted with the hydrocarbon liquid composition, whereby polar molecules in the hydrocarbon liquid composition are adsorbed by the clay treater and less polar molecules in the clay treater are desorbed into the hydrocarbon liquid composition, such that the conductivity of the hydrocarbon liquid composition is not reduced by said use. Advantageously as in other aspects, the conductivity of the hydrocarbon liquid composition is increased by said use; and in some embodiments the MSEP rating of the hydrocarbon liquid composition is also increased.

These and other aspects, objects and the benefits of this invention will become clear and apparent on studying the details of this invention and the appended claims.

DETAILED DESCRIPTION OF THE INVENTION

Figure 1:
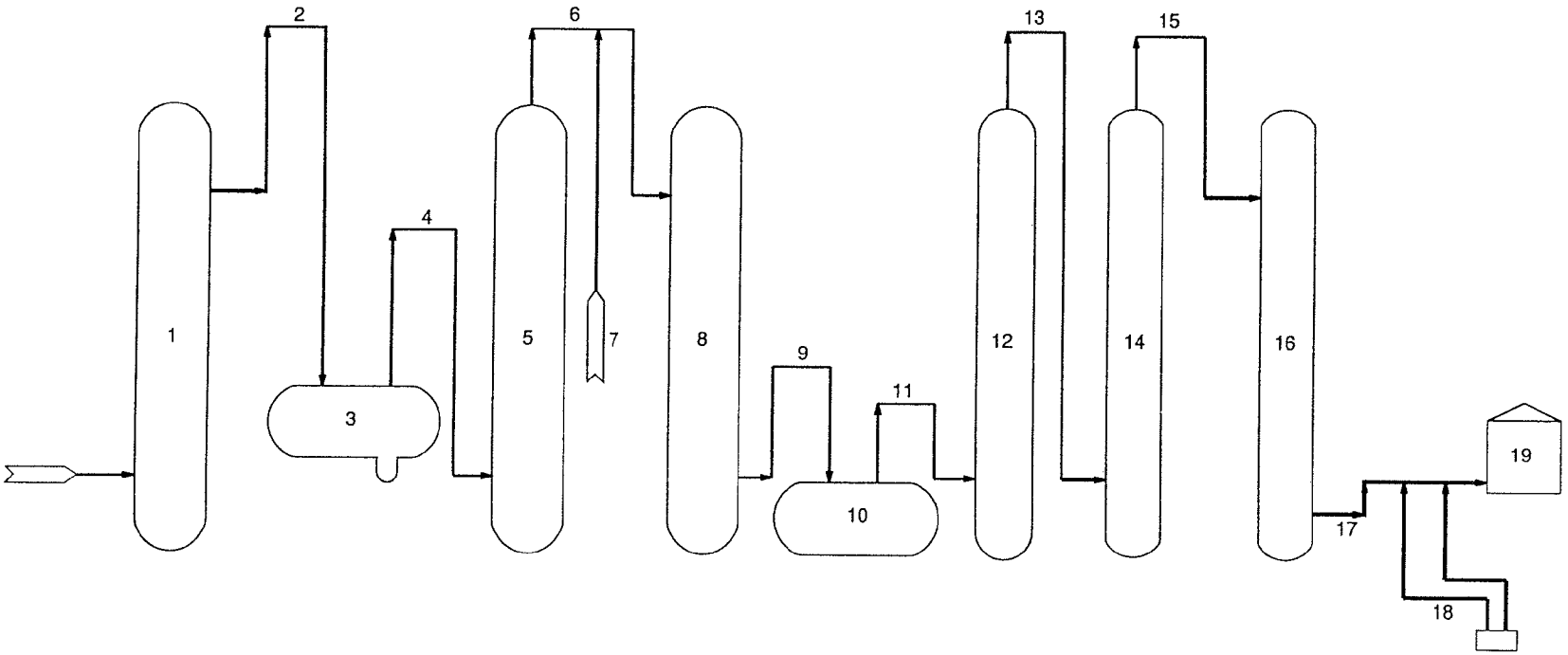
FIG. 1 is a flow diagram illustrating a conventional process for the refining of a jet fuel from kerosene originating from crude petroleum.

Prior to setting forth the invention a number of definitions are provided that will assist in the understanding of the invention.

The term "hydrocarbon liquid composition" refers to any liquid that is composed primarily of hydrocarbon molecules, including crude petroleum (crude oil) and any hydrocarbon-based products derived therefrom in all stages of refinement and purification. Typical hydrocarbon liquid compositions are disclosed herein, and by way of non-limiting example, include: petroleum crudes; condensates; and compositions including petroleum distillates, naphthas, gasolines, kerosenes, jet fuels, diesel fuels and fuel oils. Also included are certified and post-certified jet fuels, such as Merox™-treated post-certified jet fuel.

As used herein the phrase "storage and/or transportation stability" relates to the relative speed at which the properties and qualities of a hydrocarbon liquid composition deteriorate during the processes of storage and transportation. The storage stability relates specifically to deterioration in the properties and qualities of a hydrocarbon liquid composition while it is held in storage tanks or the like. The relative storage stabilities of different hydrocarbon liquid compositions could be assessed, for example, by storing samples of the respective liquid in a container. The absolute temperature of the stored hydrocarbon liquid composition may affect the storage stability, as well as exposure to temperature fluctuations. Relative measures of transportation stability can be the same as the measures of storage stability, except that any deterioration of hydrocarbon liquid composition properties and qualities are those that occur during transportation of the hydrocarbon liquid composition, for example, during pumping through pipelines. When the hydrocarbon liquid composition is stored in containers during transportation, such as on a tanker or a train, any deterioration can conveniently be considered to result as a result of "storage" instability, because the hydrocarbon liquid composition is not moving relative to the means of containment. However, in view of these clear overlaps it is preferable to consider both storage and transportation stability in unison.

The relevant properties and qualities of the hydrocarbon liquid composition concerned can be any indicator that can be either measured or detected, and which can be observed to change over time. Such properties and qualities are described herein, and by way of non-limiting example, include: concentration of metal ions and oxides, particulate matter (such as microorganisms and inorganic contaminants), conductivity levels, MSEP level, additive concentrations, viscosity, colour, surfactant concentration, water concentration and so on.

Elevated temperature typically has a detrimental affect on storage and transportation stability. Therefore, when a hydrocarbon liquid composition, such as jet fuel, is stored in a hot climate the rate of any deterioration in properties and qualities may be increased.

As used herein the term "refined" can be considered to have its usual meaning in the art. Thus, a refined hydrocarbon liquid composition is one that has been subjected to at least one process that is intended to purify it from a crude petroleum (crude oil/crude) starting material. Thus, a refined hydrocarbon liquid composition has undergone at least one process that can be considered to be a distillation, upgrading or conversion process. For example, a "straight-run" hydrocarbon liquid composition is one that is produced directly by use of distillation, without further treatment by upgrading or conversion. Typically, a refined hydrocarbon liquid composition is one that has undergone more than one refining procedure in a refinery, such as a combination of distillation, upgrading and conversion. In this case, the refined hydrocarbon liquid composition may meet known, predetermined quality parameters. A refined hydrocarbon liquid composition may also include chemical additives that have been introduced to meet desirable fuel specifications.

The term "certified" is used herein to mean that the hydrocarbon liquid composition, by refinement and/or the use of chemical additives, has been tested against and has met a set of predetermined, specified parameters relating to chemical composition, qualities and properties. Thus, a certified jet fuel is one that has meets the requirements/characteristics necessary for use in its intended purpose.

The term "post-certified" (which is used interchangeably with the term "post-certification") means that the particular hydrocarbon liquid composition to which the term refers has previously been tested against and met (i.e. satisfied) a set of predetermined, specified parameters relating to chemical composition, qualities and properties; such that it has at one time been certified. The particular hydrocarbon liquid composition may or may not still meet those specified parameters.

Production of Jet Fuel from Crude Petroleum

Processes for refining crude petroleum to produce various useful fuel products, such as jet fuels, are well known in the art (see e.g. Leffler, W. L. (1985), *Petroleum Refining for the Nontechnical Person,* $2^{nd}$ Ed., Tulsa, Okla.: PennWell). By way of example, a typical jet fuel refining process is described in *Aviation Fuels Technical Review*, Chapter 5, FTR-3 (2006), Chevron Corporation (http://www.chevronglobalaviation-.com/ga/ga_general_aviation.asp).

Typically a crude petroleum refining process to produce jet fuel may involve the following steps.

Selection of Raw Material

Crude petroleum/oil is primarily composed of hydrocarbons, but these hydrocarbons can comprise a huge variety of different types and sizes of molecules, including naphthenes, paraffins and aromatics. As a consequence the composition, properties and appearance of different sources of crude petroleum may differ vastly.

Generally, crude petroleum may be categorised as high-gravity or low-gravity according to its physical characteristics. High-gravity crude petroleum is easier and hence cheaper to refine due to its ease of handling and its relatively lower concentrations of undesirable sulphur and nitrogen components. However, virtually any crude petroleum can be refined.

The processes of this invention are applicable to any such crude petroleum and the products and intermediates of its refinement.

Separation of the Raw Material

Typically the first step in the refining of crude petroleum is its separation into more specific groups of components (i.e. fractions). Distillation is the most common separation technique.

In a distillation procedure the crude petroleum (which contains a wide mixture of products having a broad range of boiling points), is fractionated into groups of hydrocarbon molecules with similar boiling points. For example, the crude petroleum may be pumped into a distillation (or fractionation) column and heated, generally under atmospheric pressure. The boiling point of a particular compound determines the distance it travels up the column (if at all), with the molecules having the lowest boiling points travelling the furthest. Fractions of the mixture can be collected from selected heights on the column, and the components of these fractions will have similar boiling points. Gasoline, kerosene and diesel are each drawn off the distillation column at different heights.

The products of distillation (i.e. fractions) are not usually suitable for end use, and certainly not as aviation (jet) fuel.

Upgrading of Petroleum Distillates

Upgrading processes are typically catalytic reactions that remove unwanted molecules from of petroleum distillates during the petroleum refining process.

Oxidative demercaptisation, which is also known as "sweetening" in view of the effect it has on the odour of the hydrocarbon liquid composition, an important upgrading process. This process removes foul smelling, toxic, corrosive and unwanted sulfur-containing molecules, mercaptans and hydrogen sulfide, from the fuel stream by converting them into less harmful and odourous disulfides. It can also remove other unwanted trace polar compounds such as napthenates and phenols from the hydrocarbon liquid composition.

In the past various processes and catalysts have been used for sweetening of hydrocarbons mixtures. However, today the Merox™ process has almost entirely replaced those older systems. The Merox™ process has been described in detail, and is well known to the person skilled in the art (see for example, U.S. Pat. No. 7,087,547;and "*Merox™ Process for Kerosine/Jet Fuel Sweetening*"—Process Technology and Equipment, (2003), published by UOP LLC; www.uop.com). The Merox™ process is an example of a non-hydrotreatment for the removal of mercaptans.

Despite the widespread use of the Merox™ process, it is now recognised that Merox™ treatment can have detrimental knock-on effects on the quality of treated hydrocarbon liquid compositions in the downstream distribution chain. In particular, it has been noted that Merox™ catalysts used in the conversion of mercaptans may contaminate the fuel (U.S. Pat. No. 6,579,444; U.S. Pat. No. 6,485,633). This contamination does not affect the certification or the immediately measurable qualities and properties of the fuel; however, it can decrease the storage and/or transportation stability of the fuel. For example, it has been shown that Merox™-treated hydrocarbon liquid compositions display an increased rate of loss of conductivity during storage and transportation; and that adverse effects of additives and other contaminants on the abilities of water filters/coalescers to remove water and particulates in fuel, are more predominant in non-hydrotreated fuels (CRC Report No. 601; *The Effect of Stadis* 450 *on MSEP Rating and Coalescence—Technical Basis for Re-doping Turbine Fuels with Stadis* 450; July 1996; Coordinating Research Council Inc., Georgia, USA).

Alternative processes to Merox™ treatments are available, for example: the NAPFINING process provides for the caustic extraction of naphthenic acids from jet fuel, kerosene and virgin middle distillates; and the MERICAT II process combines liquid-liquid and solid-bed contact using caustic, air, catalyst and carbon to oxidise heavy mercaptans in jet fuel and middle distillate streams (both processes available and described by Merichem Chemicals & Refining Services LLC, TX, USA).

While the above upgrading processes are examples of non-hydrotreatments, hydrotreatments/hydroprocessing can also be used to remove undesirable components from a hydrocarbon liquid composition. In hydroprocessing, hydrogen and a suitable catalyst are used to remove inter alia reactive sulphur and nitrogen compounds. The severity of the process can be adjusted to determine the amount of such compounds that are removed. A significant difference to non-hydroprocessing treatments is that hydroprocessing first converts mercaptans (and other sulphur-containing molecules) into hydrogen sulphide, which must subsequently be removed from the fuel.

Clay treatment (or clay filtration; e.g. using a clay treater) is another system by which unwanted contaminants can be removed from a hydrocarbon liquid composition. Typically, the fuel is passed through a clay treater, where it comes into contact with the surface of the clay. Polar and ionic compounds, including surfactants, within the fuel are adsorbed onto the surface of the clay and thereby, removed from the fuel. Clay treatment is often used downstream of other upgrading processes, such as Merox™ treatment, in order to remove surfactants and other ionic species that may be introduced into the hydrocarbon liquid composition during that treatment.

The processes and methods of the invention are suitable for use with hydrocarbon liquid compositions that have been upgraded according to any known process. The invention is particularly useful, however, when applied to Merox™-treated hydrocarbon liquid compositions, in view of the possible downstream effects of Merox™ treatment identified herein.

Conversion Processes

As already noted, conversion processes are those wherein larger hydrocarbon molecules, typically those in heavy distillate fractions (i.e. those which do not readily boil in the distillation process) are broken (or "cracked") into smaller, more usable hydrocarbons. In this process carbon-carbon bonds in the hydrocarbon backbone are broken so that the chain length is reduced; often resulting in kerosene and diesel products.

Typically, the cracking process involves a combination of heat and a catalyst, which helps to control the breakdown products. Many refineries now use a process known as fluid catalytic cracking (FCC). An alternative to catalytic cracking is hydrocracking, in which pressurised hydrogen is used in combination with a catalyst (and heat).

The invention is suitable for use with any of the products of conversion (e.g. whether products of hydro- or catalytic-cracking), as previously described.

Chemical Additives

In many cases hydrocarbon liquid compositions can be refined to such a specification that it meets any required parameters of quality and fuel properties; even jet fuel specifications. However, in some cases, particularly where very strict specifications are in force (for example, in relation to heat stability), it may be necessary to include fuel additives, such as metal chelators, stabilisers and so on. Common fuel additives include: antibacterial agents; anti-icing chemicals; antioxidants; metal deactivator agents; corrosion inhibitors; and electrical conductivity agents (e.g. anti-static and/or static-dissipater additives) as previously discussed (Aviation Fuels: Technical Review (FTR 3), 2005, Chapter 4, Edited by Chevron Texaco).

The processes and methods of the invention are advantageously applied to hydrocarbon liquid compositions that contain any of the known chemical additives that are necessary to meet fuel standards, for example, to achieve certification. In this regard, it is particularly important to treat such certified hydrocarbon liquid compositions to avoid the possible deterioration of its properties to an extent which negates the certification.

Jet Fuel Refining Process

As will be appreciated by the person skilled in the art, the steps of a refining process designed to produce a specific type of fuel, such as jet fuel, may vary depending on the intended use of the fuel (including variations in geographic/legal requirements), and the properties of the starting material, amongst other factors. A typical, prior art process involving Merox™ treatment for refining a jet fuel will now be illustrated with reference to FIG. 1.

A crude petroleum starting material is first fed into a separation device in the form of a distillation column 1, which fractionates the crude into mixtures of hydrocarbons having closely related boiling points. The distillation column is conveniently under atmospheric pressure; although reduced pressure may also be used, especially for the fractionation of heavy distillate compounds (i.e. those that boil at very high temperatures, e.g. above 500° C.). Kerosene, which is typically used in the production of jet fuel, has an initial boiling point of approximately 147° C.

Kerosene is removed from the distillation column 1 and passaged, conveniently via a continuous pipeline 2 to a device for removing water contamination, for example, in the form of a water coalescer 3. The water coalescer 3 generally comprises a large diameter coalescer vessel that is commonly horizontally mounted. Inside the coalescer vessel is packed a coalescing media element, which is typically made up of closely woven steel wires, glass fibre strands, wood shavings and so on. A typical commercially available filter element is tag number 080915, a filter media made of wood shavings (Facet International Ltd, UK). The flow velocity of the fuel/water mixture is reduced on entering the coalescer vessel and, due to the low velocity and differences in the densities of the fuel and water, the fuel and water are segregated. As the mixture flows through the coalescer media, water coalesces into larger droplets and sinks to the bottom of the vessel from where it may be conveniently removed through a dip leg while the dry fuel passes through.

The fuel is then passed, conveniently via a continuous pipeline 4 to a container where a caustic (i.e. alkaline) prewash is carried out in a caustic prewash vessel 5. The Merox™ process requires an oxidative alkaline environment, which is conveniently created by injecting air and adding an alkaline solution (such as dilute sodium hydroxide) to the kerosene. In addition, the caustic removes hydrogen sulphide from the fuel.

From the caustic prewash 5 the alkaline fuel is passaged, conveniently by a continuous pipeline 6, to a Merox™ reactor 8. At some point air at a suitable pressure and a Merox™ catalyst are added to the kerosene in order to convert any mercaptans in the fuel into disulphides. This is conveniently accomplished by injecting air (injection point not shown) and Merox™ liquid catalyst into the fuel pipeline 6 between the caustic prewash vessel 5 and the Merox™ reactor 8, from a Merox™ liquid catalyst supply 7. In the alternative, the Merox™ reactor 8 may contain a solid bed Merox™ catalyst (for example, charcoal granules impregnated with catalyst), in which case the injection of catalyst is not necessary.

In the example depicted, which uses the Merox™ reactor 8 (sometimes referred to as a mercaptan extractor), a benefit of using a liquid catalyst is that the kerosene, catalyst, caustic and contaminants are well mixed and in contact with each other during their time within the Merox™ reactor 8. In alternative processes, the fuel may enter the reactor 8 at the bottom of the column and pass upwards, while caustic and catalyst are added at the top of the column and pass downwards through the column. In this case the column may, for example, also contain a series of trays to encourage mixing of the components.

After leaving the Merox™ reactor 8, the now sweetened fuel is passed, conveniently via pipeline 9, to a caustic settler 10. The caustic settler 10 removes any caustic that has been carried through from the reactor 8. Once the caustic has settled out it can be drained from the bottom of the settler 10.

The sweetened kerosene is then passaged from the settler 10, conveniently through a continuous pipeline 11, to a water wash vessel 12, which is designed to wash residual caustic out of the sweetened kerosene. The water wash vessel 12 typically may have a separate inlet (not shown) for the introduction of water, and a separate outlet at the bottom of the vessel (also not shown) for removing residual water. The kerosene is then passed, for example, via a continuous pipeline 13 to a salt settler vessel 14. The salt settler vessel 14 conveniently contains a bed of rock salt, which removes the entrained water from the sweetened kerosene, and an outlet at the bottom (not shown) for removing any extracted water.

In the process depicted, fuel exiting the salt settler vessel 14 via pipeline 15 is passaged into a clay treater 16. As previously described, the clay treater (16) can act as a polar trap and as a filter, removing oil-soluble substances such as metal ions and oxides, surfactants, organometallic compounds and particulate matter, which could prevent the jet fuel from satisfying the required product specifications.

Finally, the sweetened kerosene is transferred, conveniently by pipeline 17, to a storage tank 19 where it may remain until it leaves the refinery. At a convenient point before the fuel leaves the refinery it may be necessary to add chemical additives in order to satisfy the necessary product specifications/parameters. In the process shown, any additives are introduced from an additive supply 18 before the jet fuel enters the storage tank 19. It will be appreciated that before and after the addition of additives it may be necessary to test the product specifications of the sweetened kerosene (not shown).

Hydrocarbon Liquid Composition Stability

This invention relates to methods and processes for further improving the quality of hydrocarbon liquid compositions, including fractions of petroleum crudes, condensates and compositions including petroleum distillates, naphthas, gasolines, kerosenes, jet fuels, diesel fuels, fuel oils, and so on. Suitably, the hydrocarbon liquid composition is selected from a refined hydrocarbon liquid composition; more suitably it is a jet fuel, such as a certified or post-certified jet fuel; and advantageously it is a Merox™-treated jet fuel.

It has been well documented (e.g. CRC Report No. 601; *The Effect of Stadis* 450 *on MSEP Rating and Coalescence—Technical Basis for Re-doping Turbine Fuels with Stadis* 450; July 1996; Coordinating Research Council Inc., Georgia, USA), that the abilities of water filters/coalescers to remove water and particulates from jet fuel is adversely affected by additives and other contaminants, such as surfactants, and that these problems may be exacerbated in non-hydrotreated fuels (e.g. Merox™-treated fuels). This can have significant operational cost and efficiency implications, because: (i) in view of the problems with water contamination in jet fuel, it is common practice to pass jet fuel through water separators at one or more points in the supply chain between the refinery and the destination aircraft; (ii) fuel that has deteriorated can quickly disarm water filters, allowing large, undesirable quantities of contaminating water to pass into the aircraft; and (iii) once the filter has become fully disarmed and/or blocked by contaminants, the filter must be replaced or reconditioned, which can lead to regular closure of the supply chain of fuel to airports and/or into planes.

The processes and methods of the invention remove trace polar compounds and other deleterious constituents which can lead to: the deterioration of the specification parameters defining the fuel quality; and potentially to operational difficulties downstream of the fuel refinery, which can affect the performance of supply chain management.

More specifically, the methods and processes of the invention remove charged chemical moieties such as metal complexes with organic and inorganic ligands, sulfur compounds such as mercaptans and mercaptides, disulfides, naphthenates and phenolates, which are present in the fuel fractions when a crude oil or a condensate is refined. Also removed are non-metallic polar moieties that affect the interfacial behaviour of oil and a non-oil phase in the refined product streams. In this way, an improvement in the quality of hydrocarbon liquid compositions, more especially Merox™-treated jet fuels is achieved.

Accordingly, the methods and processes of the invention can lead to a surprising extension in the operational lifespan of water filters that are used in the supply chain between a fuel refinery and an aircraft. More surprisingly, the methods and processes of the invention can lead to improvements in the conductivity of a hydrocarbon liquid composition and/or the water separability of the hydrocarbon liquid composition. Thus, the invention provides the particular advantages that redoping of jet fuels, for example, with anti-static additives or static dissipater compounds (which may be expensive and/or not readily available) to improve conductivity can be reduced; and the efficiency of water separability may even be improved.

Figure 2:
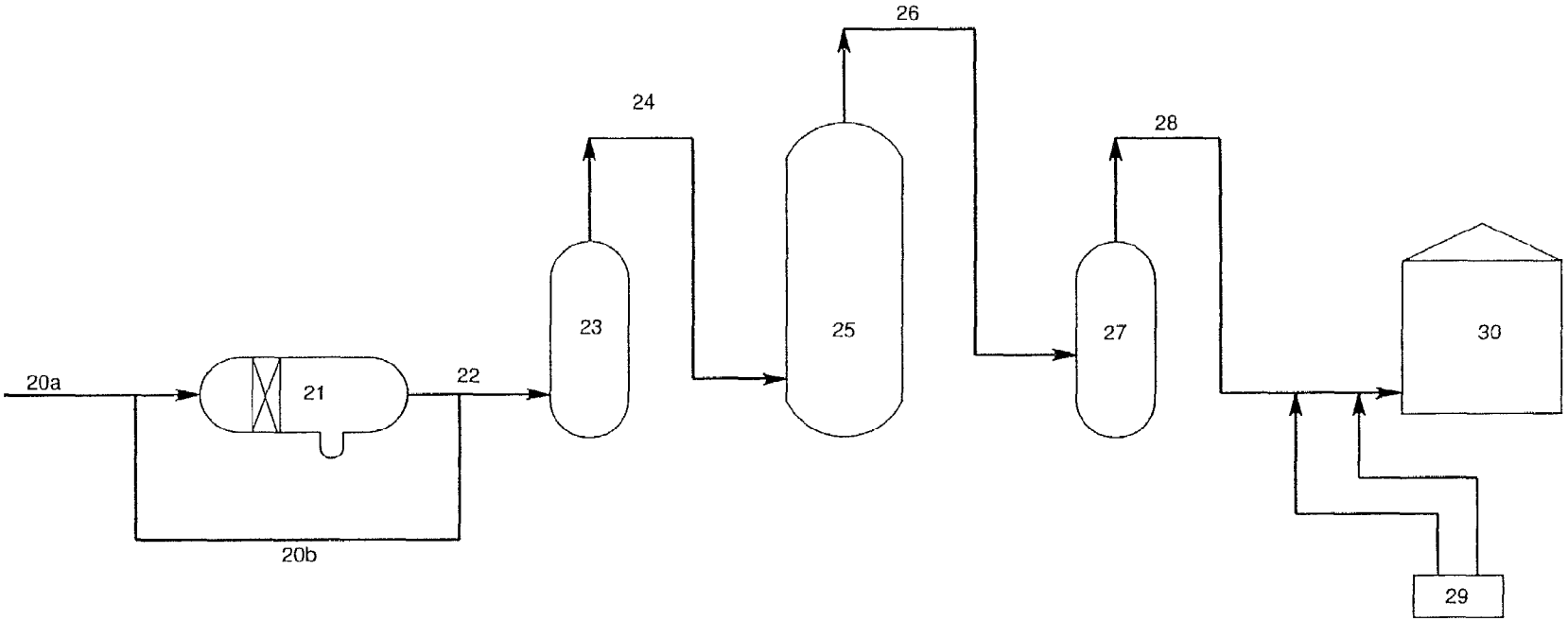
FIG. 2 is a flow diagram of a process for improving the storage and/or transportation stability of a hydrocarbon liquid composition in accordance with an embodiment of the invention.

A non-limiting example of the processes and methods of the invention will now be described with reference to FIG. 2.

According to the example, a hydrocarbon liquid composition, in the form of a Merox™-treated jet fuel, is optionally passed via pipeline 20*a* into a device, primarily for removing water from the fuel, in the form of dehydrator 21. Dehydrator 21 is also capable of removing any tramped particulate matter of a size typically greater than several microns (μms). The dehydrator 21 is a suitably sized large diameter vessel that typically contains a closely packed media bed covering the entire inner cross section of the vessel. The media bed may suitably comprise densely and randomly packed strands of Excelsior (Aspen wood shavings/fibres), fibre glass, polyester, wood shavings, steel coils or combinations thereof. Fuel together with contaminants in the form of free water or an emulsified aqueous layer flows through the bed at a low velocity, the phases separate out (as previously mentioned) and the aqueous component settles to the bottom of the vessel. The dehydrator 21 is advantageously provided with an outlet at the bottom of the vessel in the form of a dip leg, for the convenient removal of water that has been extracted from the fuel. A suitable commercially available dehydrator is model L-1600 manufactured by Warner Lewis, Jr., Industrie-Filter GmbH (Germany). One or more dehydrators (e.g. 1, 2 or 3) may be used; typically, only one dehydrator 21 is used. Fuel exiting the dehydrator 21 is passaged to a filter device in the form of a micronic filter 23, conveniently via a continuous pipeline 22.

In an alternative embodiment a dehydrator 21 is not used and, in this case, the Merox™-treated jet fuel is passed through pipeline 20*b*, 22 directly into a filter device in the form of a micronic filter 23. The micronic filter removes any visible and microscopic particles from the fuel, which are larger than the pore size of the filter. Suitably, micronic filter 23 has a pore size in the region of 5 μm; however, filters of smaller pore size, for example 1 μm are also suitable. A suitable micronic filter is type VF-5444/39 manufactured by Velcon Filters. Warner Lewis, Jr., Industrie-Filter GmbH (Germany) also manufactures similar filters.

The use of such a micronic filter has been found to be particularly beneficial in ensuring that the downstream processes are not affected by any carry over of particulate matter that may be generated either in situ or due to pick up during the process of transfer The filtered fuel is then passed, conveniently via a continuous pipeline 24, into a polar trap in the form of a clay treater 25.

The polar trap advantageously comprises a material selected from the group consisting of clay, Fuller's earth, activated alumina, silica, and zeolites. In one embodiment, the polar trap is a clay treater, which contains attapulgus clay (Fuller's earth). A suitable clay treater is type 60F3-C-766-4 manufactured by Facet (USA). One or more, for example, 1, 2 or 3 clay treaters may be used either sequentially or in parallel operations. Advantageously the one or more clay treaters are used in parallel, depending on the flow rate of the fuel.

In accordance with the embodiment of the invention depicted, fuel from the clay treater 25 is then transferred, conveniently through pipeline 26, to micronic filter 27. The micronic filter 27 is conveniently the same type as micronic filter 23, described above, but may be different. The filter pore size is also suitably 5 μm, although a different pore size may be used, as appropriate. The micronic filter 27 serves the purpose of removing, if necessary, any clay particles or other particulate matter, so that these particles are prevented from being transported further downstream into the clean fuel storage tanks.

From micronic filter 27, fuel is conveniently transferred into a storage tank 30, for storage until it is required for use. A continuous pipeline 28 can be used to transfer fuel to the storage tank 30.

Optionally, the fuel exiting the clay treater 25 is not diverted through micronic filter 27. For example, fuel may be passaged directly from the clay treater 25 into the storage tank 30, via pipelines not shown.

At any point downstream of the clay treater 25, the fuel's properties (for example, including conductivity and water separability), may be tested; and the fuel may be supplemented with chemical additives, if necessary, to improve its parameters. As depicted, chemical additives 29 may conveniently be added to the fuel before it is introduced into the storage tank 30.

In beneficial embodiments of the invention, the fuel downstream of the clay treater is at least tested for conductivity, and an anti-static additive or static dissipater compound is redoped into the fuel, as appropriate, in order to achieve a predetermined, appropriate level of conductivity. Advantageously, the fuel's conductivity is tested before and after any redoping or addition of additives as indicated at 29. It will be appreciated that chemical additives may in the alternative, or in addition, be added to the fuel in the storage tank 30, or before the fuel passes through micronic filter 27.

In a further embodiment of the invention, the MSEP (or WSIM) rating of the fuel is also tested.

It may also be convenient to test the fuel's properties, such as conductivity and optionally water separability before the fuel is passed through the clay treater 25. This is beneficial for monitoring the action of the clay treater 25.

It will, of course, be appreciated that the storage tank 30 is an optional feature of the invention. For instance, fuel from the clay treater 25 or the micronic filter 27 may be passaged into a means of transportation (for transfer to another facility), or directly into an aeroplane for use.

As previously noted, and as demonstrated in the following examples, it has surprisingly been found that the conductivity of the fuel exiting the clay treater 25 is no lower than, and may even be higher than the conductivity of the fuel before entering the clay treater. This finding is against the conventional wisdom of the person skilled in the art.

In this regard, the use of a clay treater is known in the refining of crude petroleum to remove ionic molecules, surfactants and other contaminating particles, as described hereinbefore. For example, U.S. Pat. No. 2,090,007 (1937) describes a process in which fuel is passed through a column containing Fuller's earth or charcoal as a medium to remove the impurities and improve the quality of the resulting product. U.S. Pat. No. 2,338,142 (1944) describes filtering a fuel fraction (gasoline) through a bed of natural earth such as clay, bauxite, Fuller's earth to improve the fuel. U.S. Pat. No. 4,225,319 (1980) provides a general statement regarding the removing of oxygen, nitrogen and sulfur compounds from cracked gasolines using adsorbent materials such as charcoal, silica-alumina clay, magnesia and Fuller's earth. U.S. Pat. No. 4,053,367 (1977) describes the use of a clay treater (comprising alumina, silica, magnesia or zirconia) to remove "olefinic" material and improve the colour of a hydrocarbon stream. U.S. Pat. No. 6,422,396 (2002), which relates to a new coalescer media used to separate a discontinuous phase of water from a continuous phase of hydrocarbons, such as jet fuel, indicates that a clay treater adsorbs and removes all surfactants.

Accordingly, a clay treater is known and used to remove ionic moieties and surfactants from a hydrocarbon liquid composition, and in all events, this would lead to a concomitant reduction in conductivity. Indeed, during the refining process itself, anti-static additives and/or static dissipater compounds are added after clay treatment, when used, to ensure that the conductivity of the fuel is within acceptable limits.

The finding that the use of a polar trap in accordance with the invention actually maintains or even increases its conductivity, as evidenced by an increase in conductive reading of the downstream fuel stream, is a particular advantage of the invention.

Without being bound by theory, it is thought that at least some of the beneficial effects of the invention are achieved by the use of the polar trap as a polar-exchanger. That is, the polar trap used in accordance with the invention may adsorb the undesirable (highly) polar moieties from the hydrocarbon liquid composition, and surprisingly, exchange those more polar substances (such as metal ions) in the fuel, with less polar moieties, for example, by desorbing the less polar substances from the clay treater, and possibly also by not absorbing such molecules from the fuel. Such a less polar moiety could be, for example, an anti-static additive or static dissipater compound such as Stadis® 450.

In this way, the processes and methods of the invention remove from hydrocarbon liquid compositions the small quantities (e.g. sub-ppm levels) of impurities whose presence in the fuel can trigger a deterioration of quality parameters of jet fuels on storage and/or transportation, which can lead to the rapid disarming/deactivation of downstream water filters. In addition, by using this invention a smooth flow of a hydrocarbon liquid composition through a downstream pipeline is ensured without any increase in particulate matter, which may otherwise be generated by interactions between contaminants in the fuel and the inner surfaces of the pipeline.

After a hydrocarbon liquid composition has been treated in accordance with the invention it may be necessary or advantageous to introduce chemical additives into the treated fuel. Any suitable additives may be used. A further benefit of the invention is that it is not necessary to heavily redope the fuel, after treatment, with anti-static additive or static dissipater compounds in order to achieve an acceptable conductivity level. Redoping may be necessary, depending on requirements, but not at levels above that which would otherwise have been necessary. Thus, the invention addresses an additional problem that has been reported in the prior art, regarding the detrimental effects on water separability (MSEP rating), caused by redoping a fuel with anti-static additives, such as Stadis® 450: a problem that is particularly apparent with non-hydrotreated fuels.

Accordingly, it is beneficial to measure the fuel properties of interest, such as conductivity and water separability, after treatment according to the invention, to determine what additives may be necessary; and by comparing the respective measurements to known specified property parameters, determine the appropriate quantities of each additive to introduce. Advantageously, therefore, the methods and processes of the invention may include: measuring, at regular intervals, one or more parameter of the fuel after treatment in accordance with the invention; and optionally introducing one or more fuel additives to meet particular specification parameters. Beneficially, the one or more parameters include fuel conductivity. More suitably, the one or more parameters include fuel conductivity and water separability. The regular intervals may be determined by time periods or by quantity of fuel treated. Typically, the one or more fuel additives include an anti-static additive and/or a static dissipater additive; suitably, the one or more fuel additives comprises Stadis® 450. In beneficial embodiments the one or more fuel additives are injected into the treated hydrocarbon liquid composition downstream of the polar trap, and advantageously, when used, downstream of the final micronic filter. The additives may, for example, be added before the treated fuel is transferred into a storage tank, or once the fuel is in a storage tank. Where additives are introduced before storage, for example in a pipeline, the quantity of additive introduced may depend on the flow rate of the fuel, the measured parameters of the fuel and the target parameters of the fuel.

In some cases it may be preferable to divert a flow of treated fuel to different locations (e.g. separate storage tanks), according to the measured parameters. For example, where some fractions of the treated fuel do not require any additives, it may be beneficial to divide that fuel from similar fractions which require the addition of certain additives. In this way treated fuel fractions with particularly advantageous properties can be used or stored separately from other volumes of treated fuel.

Another surprising outcome of this invention is that the MSEP (WSIM) rating of the fuel downstream of the filter system may increase, and may remain higher than its MSEP rating before treatment with a polar trap, even after further doping of anti-static additives to maintain the conductivity levels as mandated by the fuel specification. This finding is also against the conventional wisdom of the person skilled in the art, because as already discussed, the redoping of a fuel with anti-static additives is expected to decrease the water separability.

It has been found that a dehydrator 21, although not essential to the invention, is beneficial in maximising the benefits of the invention. While the main function of the dehydrator 21 is to remove excessive water that could lead to the premature inactivation of the polar trap (e.g. clay treater), it also helps in trapping and removing particulate matter, thereby improving the efficiency of downstream operations.

The efficacy of the methods and processes of the invention is further optimised to achieve maximum benefit by passing the hydrocarbon liquid composition through the clay treater and other components (e.g. dehydrator and micronic filters, when used) at an optimised flow rate.

Typically the flow rate of the hydrocarbon liquid composition is between 100 and 1000 $m^3$ per hour, suitably between 300 and 1000 $m^3$ per hour, more suitably between 400 and 800 $m^3$ per hour, and still more suitably between 500 and 700 $m^3$ per hour. Thus, in some advantageous embodiments the flow rate of the hydrocarbon liquid composition may be maintained at approximately 500, approximately 600 or approximately 700 $m^3$ per hour.

Depending on the type of hydrocarbon liquid composition, the optimal flow rate may vary slightly. It is, however, within the ability of the person skilled in the art to test different flow rates within the above limits, and by measuring the conductivity (and optionally the water separability) of the fuel either side of the apparatus of the invention (e.g. either side of the polar trap), to determine the optimal flow rate for the system.

Another factor for consideration is the pressure drop across the clay treater 25 when used in accordance with the invention. A suitable pressure drop is between 5 and 20 psi, suitably between 12 and 17 psi and more suitably about 15 psi (despite that some manufacturers suggest that if the differential pressure across a clay treater reaches 15 psig, the clay has become ineffective—Velcon Filters Inc., CO-718CE Clay Canisters—The Clarifier Vol 13, number 1, April 2002).

In addition, the invention can operate over a wide range of MSEP (or WSIM) ratings. In this regard, the methods and processes of the invention have successfully: (i) improved the storage and/or transportation stability of hydrocarbon liquid compositions; and/or (ii) increased the conductivity of hydrocarbon liquid compositions; and/or (iii) increased the WSIM rating of hydrocarbon liquid compositions; starting with hydrocarbon liquid compositions having initial WSIM ratings of as low as 70 (the minimum allowable rating for in specification jet fuels doped with anti-static additives). Again, when using fuels of different WSIM rating (for example, 70 or 90), it may be necessary to optimise the flow rate of the fuel according to its WSIM rating. As already indicated above, any such flow rate adjustments and parameter measurements that may be beneficial for achieving the optimal effect are within the capabilities of the person skilled in the art. In this regard, if the WSIM rating is reduced, the fuel flow rate typically should be lowered, such that the contact time in the clay treater is extended. When a dehydrator is used in front of a clay treater, the reduced flow rate is typically applied through both apparatus, so that the contact time in each of the dehydrator and the clay treater is extended.

The overall efficacy of the improvement in performance achieved by the invention is evidenced by the fact that the throughput across conventional filter water separators (FWS) in an airport was found to increase by more than 300-fold by first treating the jet fuel in accordance with the invention (see Examples below).

The entire contents of the patents and other references cited herein are hereby incorporated in this patent application in their entirety.

The invention is now illustrated and exemplified by the following non-limiting examples.

EXAMPLES

As shown in Example 1, the efficacy of the invention has been demonstrated by measurement of conductivity made on Merox™-treated jet fuel both before and after subjecting the fuel to the process of the invention. In Example 2, the efficacy of the invention has been demonstrated by measurement of WSIM rating made on Merox™-treated jet fuel both before and after subjecting the fuel to the process of the invention. In Example 3, the efficacy of the invention has been demonstrated by measurements of the throughput of Merox™-treated jet fuel across the water filter (FWS) at an airport made both before and after subjecting the fuel to the methods and processes of the invention.

Unless otherwise stated, all equipment used in the course of conducting the examples is standard in the art, and all measurements taken use standard equipment and systems that will be known to the skilled person in the art.

Example 1

In this example a Merox™-treated jet fuel was passed through a clay treater containing attapulgus clay at a flow rate of approximately 500 to 650 $m^3$/hr. Micronic filters (23,27 as indicated in FIG. 2) were used during all the transfers. A dehydrator (or Haypack) was also included in the last example of Table 1.

Measurements of fuel conductivity were taken from samples of fuel immediately before and after passage through the clay treater, using Model 1140 Micro-Separometer Mark V Deluxe (available from EMCEE Electronics, Inc., 520, Cypress Ave., Venice, Fla. 34292, USA).

Table 1 demonstrates the results of conductivity measurements taken on fuel samples before and after treatment according to the invention. The data clearly illustrates the increase in conductivity achieved by the process of the invention for a post-certification jet fuel.

TABLE 1

Conductivity Measurements of Fuel Before/After Clay Treater

| Conductivity Before Clay Treater (Conductivity Units, CU, pS/m)[1;2] | Conductivity After Clay Treater (Conductivity Units, CU, pS/m)[1;2] |
|---|---|
| 110 | 128 |
| 114 | 125 |
| 65 | 70 |
| 40 | 120 |
| 38 | 115 |
| 105[3] | 195[3] |

Notes:
The temperature of the fuel samples measured were in all cases within 2° C. of each other and were made in duplicate within a 5 minute time interval.
Results are live data from plant operations on random dates when inter tank operations was in progress.
Dehydrate (haypack) also used as indicated in FIG. 2.

Example 2

In this example a Merox™-treated jet fuel was passed through a clay treater containing attapulgus clay at a flow rate of approximately 500 $m^3$/hr. Micronic filters (23,27 as indicated in FIG. 2) were used during all the transfers. Dehydrators were not used in this study.

Measurements of WSIM rating (measured using the Water Separometer Index, Modified; or MSEP rating) were taken from stored fuel samples immediately before and after passage through the clay treater, using a Model 1140 Micro-Separometer Mark V Deluxe (EMCEE Electronics, Inc., 520, Cypress Ave., Venice, Fla. 34292, USA)

The same samples were also tested for fuel conductivity, as before, using a Model 1152 portable conductivity meter available from EMCEE Electronics, Inc., (USA).

Table 2 demonstrates the results of the WSIM rating and fuel conductivity measurements taken on a typical fuel sample before and after treatment according to the invention. The data illustrates that the WSIM rating of the fuel after treatment according to the invention and after redoping with 0.41 mg/L of static dissipater additive (SDA) Stadis® 450 was higher than the WSIM rating of the fuel before treatment. In addition, the data indicates that for the same samples, the conductivity of the fuel after treatment was significantly higher than it was before treatment.

TABLE 2

WSIM/Conductivity/Flow Rate Values Before/After Treatment

| | Tank Before Treatment | Tank After Treatment |
|---|---|---|
| WSIM | 81* | 93** |
| Conductivity | 79 (34° C.) | 173 (27° C.) |
| Flow Rate[1] | 500 $M^3$ per hour | |

Notes:
Initial doping of SDA at refinery tank: 1.28 mg/L
**Second doping of SDA at terminal tank: 0.41 mg/L
The flow rate is the throughput rate for inter-tank transfer across the treating unit.

The observed increase in water separability (WSIM rating) achieved by the invention is particularly surprising and advantageous because the addition of SDA (i.e. redoping) would be expected to actually lower the WSIM rating of the fuel into which the SDA was added. A significant benefit is, therefore, achieved by the invention, because SDA chemicals can be expensive and not readily available for use. The processes and methods of the invention thus decrease the requirement for redoping of fuel, particularly certified fuels, and more especially Merox™-treated jet fuels, in order to achieve and/or maintain the required fuel specifications.

Example 3

In this example a standard procedure for the transfer of Merox™-treated jet fuel from a refinery to an aircraft was compared to a process in which the fuel was treated according to the invention en route to the aircraft.

In the standard (prior art) procedure, Merox™-treated jet fuel produced at a refinery is transported (typically by tanker) from the refinery to a shore-side intermediate fuel terminal. From the storage tanks of the terminal the fuel is then pumped through a 57 km pipeline (across a desert terrain) to the airport terminal. At the airport terminal the fuel is passed through a Facet model VSC-956-444 type filter water separator (FWS) consisting of coalescer type CA-56-5 and a separator type SS-T644-FD to remove water and particle contamination before being transferred to an aircraft for use. The coalescer needs replacement when the differential pressure reaches 15 psig and the FWS is then considered disarmed.

In the modified procedure, the Merox™-treated jet fuel was treated in accordance with the invention at the intermediate fuel terminal before being pumped through the 57 km pipeline to the airport terminal. A process according to the invention was achieved by treating the fuel as per the process described in relation to in FIG. 2 (i.e. at all times the fuel was passed through micronic filters and a clay treater containing attapulgus clay; however, a dehydrator was used only intermittently as necessary). The fuel flow rate was varied between approximately 450 and 800 $m^3$/hr. It should be appreciated that the data presented was collected over a time period of several months, which was necessary when the improvements due to the invention were manifest.

In order to determine the benefits of using the invention, measurements were taken of the amount of fuel that could be effectively treated by the FWS at the airport terminal before it was necessary to decommission and replace FWS. Table 3 provides typical data on the volume of Merox™-treated jet fuel able to pass through the FWS before installation of the new treatment system, compared to the throughput of fuel after installation of the treatment system.

TABLE 3

FWS Cartridges Data At Airport End: Throughput Data ($M^3$) Per Change Of A Set Of Cartridges

| Before Installation ($M^3$)[1] | After Installation ($M^3$)[1] | Improvement factor |
|---|---|---|
| 4,391 | 335,694 | 76.5 |
| 4,424 | 626,067 | 142 |
| 4,028 | 1,287,820 | 320 |
| 6,830 | 1,001,792 | 147 |

Notes:
Each set of 9 coalescer type CA-56-5 cartridges which comprised a part of the FWS separator were replaced once a specific pressure drop of 15 psig was measured for the flow of fuel across it. However, where a different type (or make) of FWS is used, it may be necessary to change a different number or type of cartridges.

In view of the data in Table 3, the efficacy of the methods and processes of the invention are clearly manifested by large increases in fuel throughput across a FWS downstream of the new treatment system. The benefits of the invention may be particularly evident because the location of these tests has a generally hot climate and the fuel is pumped through a long pipeline before its use.

In summary, the present invention improves the quality of Merox™-treated jet fuels by providing greater storage and/or transportation stability in the fuel's specification properties, and more particularly in its abilities to retain or improve conductivity and advantageously to simultaneously improve its interfacial properties as evidenced by an improvement in MSEP ratings (ASTM D 3948-99a: Standard Test Method for Determining Water Separation Characteristics of Aviation Turbine Fuels by Portable Separometer). The benefits of the invention may, at least in part, result from the action of the polar trap, suitably a clay treater, as a polar-exchanger, wherein more polar moieties in the fuel are removed leaving less polar, conductive molecules in the fuel, and possibly, these less polar molecules are also desorbed into the fuel. Such less polar molecules may include weak surfactants, such as anti-static additive (ASA) or static dissipative additive (SDA), e.g. Stadis® 450. The optimum performance of the methods and processes of the invention is dependent on fuel flow rate through the polar trap, and in this regard, it is beneficial to have a flow rate of between 400 and 800 $m^3$ per hour, and it is particularly advantageous to have a flow rate between 500 and 700 $m^3$ per hour. Although the invention has been demonstrated to achieve particularly advantageous effects in the treatment of Merox™-treated jet fuels, it will be appreciated that the invention is applicable to other hydrocarbon liquid compositions that are subject to deterioration during storage and transportation. The invention brings a huge benefit over the fuel storage and transportation systems currently practiced in the industry.

The invention claimed is:

1. A process for improving the stability of a post-certification jet fuel which has been subject to deterioration during storage and/or transportation, the process comprising:

contacting the post-certification jet fuel with a dehydrator; and contacting the post-certification jet fuel with a polar trap, wherein the conductivity of the post-certification jet fuel is not reduced by said contacting with a polar trap.

2. The process of claim 1, wherein the conductivity of the post-certification jet fuel is increased by said contacting with a polar trap.

3. The process of claim 1, wherein the post-certification jet fuel is a MEROX-treated post-certification jet fuel.

4. The process of claim 1, wherein the polar trap comprises a material selected from the group consisting of clay, Fuller's earth, activated alumina, silica, and zeolites.

5. The process of claim 1, wherein the polar trap is a clay treater.

6. The process of claim 1, wherein the polar trap is a clay treater, and wherein the clay treater comprises attapulgus clay.

7. The process of claim 1, wherein the MSEP rating (measured using the Water Separometer Index, Modified, WSIM rating) of the post-certification jet fuel is increased by said contacting with a polar trap.

8. The process of claim 1, comprising passing the post-certification jet fuel through the polar trap at a flow rate of between about 100 and about 1000 $m^3$ per hour.

9. The process of claim 1, comprising passing the post-certification jet fuel through the polar trap at a flow rate of between about 300 and about 1000 $m^3$ per hour; between about 400 and about 800 $m^3$ per hour; or between about 500 and about 700 $m^3$ per hour.

10. The process of claim 1, wherein the polar trap adsorbs from the post-certification jet fuel charged chemical moieties (polar molecules), such as metal complexes with organic and inorganic ligands, sulfur compounds such as mercaptans and mercaptides, disulfides and napthenates, and desorbs less polar molecules, such as Anti-Static Additive (ASA).

11. The process of claim 1, wherein said contacting with a polar trap is performed immediately prior to the storage and/or transportation of the post-certification jet fuel.

12. The process of claim 1, wherein before said contacting with a polar trap is performed the post-certification jet fuel is contacted with a micronic filter.

13. The process of claim 12, wherein before said contacting with a polar trap is performed the post-certification jet fuel is sequentially contacted with said dehydrator and said micronic filter.

14. The process of claim 1, which comprises sequentially the steps of passing the post-certification jet fuel through:

(a) said dehydrator; and (b) said polar trap comprising a clay treater, at a flow rate of between about 100 and about 1000 $m^3$ per hour;

and wherein the conductivity of the post-certification jet fuel immediately following step (b) is not less than the conductivity of the post-certification jet fuel immediately preceding step (b).

15. The process of claim 1, which comprises sequentially the steps of passing the post-certification jet fuel through:

(a) said dehydrator;

(a') a micronic filter; and (b) said polar trap comprising a clay treater, at a flow rate of between about 100 and about 1000 $m^3$ per hour;

and wherein the conductivity of the post-certification jet fuel immediately following step (b) is not less than the conductivity of the post-certification jet fuel immediately preceding step (b).

16. The process of claim 1, which comprises sequentially the steps of passing the post-certification jet fuel through:

(a) said dehydrator;

(a') a micronic filter;

(b) said polar trap comprising a clay treater, at a flow rate of between about 100 and about 1000 $m^3$ per hour; and (c) a micronic filter;

and wherein to conductivity of to post-certification jet fuel immediately following step (b) is not less than to conductivity of to post-certification jet fuel immediately preceding step (b).

17. A process for treating a post-certification jet fuel which has been subject to deterioration during storage and/or transportation, comprising sequentially to steps of pining to post-certification jet fuel though:

a dehydrator; and a polar trap;

at a rate of between about 100 and about 1000 $m^3$ per hour.

18. The process of claim 17, which further comprises, between steps (a) and (b), the step of:

(a') passing to post-certification jet fuel through a micronic filter.

19. The process of claim 17, which further comprises, between steps (a) and (b), the step of:

(a') passing to post-certification jet fuel trough a micronic filter of approximately 5 μm pore size.

20. The process of claim 17, which further comprises after step (b), the step of:

(c) passing to post-certification jet fuel though a micronic filter.

21. The process of claim 17, which further comprises, between steps (a) and (b), the step of:

(a') passing to post-certification jet fuel through a micronic filter of approximately 5 μm pore size;

and after step (b), the step of:

(c) passing to post-certification jet fuel through a micronic filter of approximately 5 μm pore size.

22. The process of claim 17, wherein the post-certification jet fuel is a MEROX-treated post-certification jet fuel.

23. The process of claim 17, wherein the flow rate of the post-certification jet fuel is between about 300 and about 1000 $m^3$ per hour, between about 400 and about 800 $m^3$ per hour, or between about 500 and about 700 $m^3$ per hour.

24. The process of claim 17, wherein the polar trap comprises a material selected from the group consisting of clay, Fuller's earth, activated alumina, silica, and zeolites.

25. The process of claim 17, wherein the polar trap is a clay treater.

26. The process of claim 17, wherein the polar trap is a clay treater, and wherein the clay treater comprises attapulgus clay.

27. The process of claim 17, wherein the conductivity of the post-certification jet fuel immediately following step (b) is higher than the conductivity of the post-certification jet fuel immediately preceding step (b).

28. The process of claim 17, wherein the conductivity and the MSEP rating (measured using the Water Separometer Index, Modified, WSIM rating) of the post-certification jet fuel immediately following step (b) are higher than the conductivity and the MSEP rating of the post-certification jet fuel immediately preceding step (b).

* * * * *

UNITED STATES PATENT AND TRADEMARK OFFICE

CERTIFICATE OF CORRECTION

PATENT NO. : 7,691,258 B2
APPLICATION NO. : 11/757542
DATED : April 6, 2010
INVENTOR(S) : Venkateshan It is certified that error appears in the above-identified patent and that said Letters Patent is hereby corrected as shown below:

Col. 23, Line 5, Claim 3 "MEROX" should read --MEROX™--;

Col. 24, Line 16, Claim 17 "at a rate" should read --at a flow rate--; and

Col. 24, Line 23, Claim 19 "trough" should read --through--.

Signed and Sealed this

Thirtieth Day of November, 2010

David J. Kappos

David J. Kappos
*Director of the United States Patent and Trademark Office*